United States Patent [19]

Oda et al.

[11] Patent Number: 4,486,278

[45] Date of Patent: Dec. 4, 1984

[54] CATHODE AND ELECTROLYSIS

[75] Inventors: Yoshio Oda; Hiroshi Otouma; Eiji Endoh, all of Yokohama, Japan

[73] Assignee: Asahi Glass Company Ltd., Tokyo, Japan

[21] Appl. No.: 511,725

[22] Filed: Jul. 8, 1983

Related U.S. Application Data

[63] Continuation of Ser. No. 346,245, Feb. 5, 1982, abandoned.

[30] Foreign Application Priority Data

Feb. 27, 1981 [JP] Japan ..... 56-26921

[51] Int. Cl.[3] ..... C25B 1/14; C25B 11/00

[52] U.S. Cl. ..... 204/98; 204/128; 204/129; 204/290 R

[58] Field of Search ..... 204/290 R, 94, 129, 204/98, 128; 252/425.3

[56] References Cited

U.S. PATENT DOCUMENTS

| | | | |
|---|---|---|---|
| 4,169,025 | 9/1979 | Needes | 204/290 R |
| 4,295,951 | 10/1981 | Bommaraju | 204/290 R |
| 4,357,262 | 11/1982 | Solomon | 204/290 R |

*Primary Examiner*—John F. Niebling

*Attorney, Agent, or Firm*—Oblon, Fisher, Spivak, McClelland & Maier

[57] ABSTRACT

A gas evolution cathode comprises a rough surface layer on a liquid non-permeable substrate and a fine electron non-conductive material which is discontinuously, uniformly distributed on said rough, surface layer.

6 Claims, No Drawings

CATHODE AND ELECTROLYSIS

This application is a continuation of application Ser. No. 346,245, filed Feb. 5, 1982 now abandoned.

BACKGROUND OF THE INVENTION

1. Field of the Invention

The present invention relates to a cathode and a preparation thereof and an electrolysis using the cathode. More particularly, it relates to a gas evolution cathode having high durability.

2. Description of the Prior Art

The gas evolution cathode has been industrially used as a cathode in an apparatus for electrolysis of an aqueous solution of an alkali metal chloride, sea water (brine), water or hydrochloric acid. Various apparatuses equipped with the cathode have been considered. Thus, an apparatus comprising a liquid permeable or liquid non-permeable diaphragm between an anode compartment having an anode and a cathode compartment having a cathode has been usually used.

An electrolysis of an aqueous solution of an alkali metal chloride especially an ion-exchange membrane type electrolysis of a brine will be illustrated.

An aqueous solution of sodium chloride (a brine) as an electrolyte solution is fed into the anode compartment and water or a dilute aqueous solution of sodium hydroxide is fed into the cathode compartment. As a result of the electrolysis, hydrogen evolves on the cathode and chlorine evolves on the anode. It has been well-known when such gas evolution cathode is used, iron-containing ions such as $HFeO_2^-$ formed by dissolving the cell material etc. in an aqueous solution of sodium hydroxide as a catholyte is reduced into Fe or iron oxides which is deposited on the cathode. It is considered that a reduction rate or an electrodeposition rate is increased on the gas evolution cathode by the electrolyte-stirring effect resulted by the gas evolution.

As a cathode used for such electrolysis and a preparation thereof, the inventors have proposed the cathode obtained by electrolytic codeposition of electrochemically active particles made of Raney nickel etc. with nickel etc. on a cathode substrate as Japanese Unexamined Patent Publication No. 112785/1979 and a preparation thereof. The resulting cathode has been a cathode for remarkably low hydrogen overvoltage in comparison with the known cathodes. However, it has been found that the hydrogen overvoltage of the cathode gradually rises in a system containing iron-containing ions at a content of several ppm or more. Moreover, the deposition of iron or iron oxide on the cathode has been found. According to various studies of the reason, it has been found that an iron component of the iron-containing ions in the catholyte is deposited on the cathode as a water insoluble solid such as iron, iron oxide or iron hydroxide.

SUMMARY OF THE INVENTION

It is an object of the present invention to provide a cathode which can effectively prevent said disadvantageous phenomena; a preparation thereof and an electrolysis by using said cathode.

The foregoing objects of the present invention have been attained by providing a gas evolution cathode comprising a rough surface layer on a liquid non-permeable substrate and a fine electrically non-conductive material which is discontinuously, uniformly distributed on said rough surface layer. It also provides a process for producing a cathode by dipping a gas evolution cathode having a rough surface layer on said liquid non-permeable substrate into a solution or dispersion of an electrically non-conductive material; or electrophoretically depositing the material on it in said dispersion or spraying said solution or dispersion to distribute said electrically non-conductive material discontinuously and uniformly on said rough surface layer. It also provides an electrolysis of an aqueous solution of an alkali metal halide, sea water, water or a hydrogen halide acid by using a gas evolution cathode having a rough surface layer on a liquid non-permeable substrate and a fine electrically non-conductive material which is discontinuously, uniformly dispersed on said rough surface layer.

DETAILED DESCRIPTION OF THE PREFERRED EMBODIMENTS

The gas evolution cathode used in the present invention can be the electrode obtained by an electric plating by immersing a liquid non-permeable electrode substrate made of iron etc. into a nickel plating bath in which metallic particles such as leached or non-leached Raney nickel particles are dispersed as disclosed in Japanese Unexamined Patent Publication No. 112785/1979; or an etching or a sand-blasting of a surface of an electrode substrate as disclosed in Japanese Examined Patent Publication No. 19229/1979 or Japanese Unexamined Patent Publication No. 115626/1979.

The surface of the electrode is a rough surface forming many projections of metallic particles or a rough surface layer formed by the etching or sand-blasting treatment. The roughness of the surface is not critical and the density of the projections or voids is preferably in a range of $10^4$–$10^{12}$ per $cm^2$ and the thickness of the rough surface layer is preferably in a range of 1–1000$\mu$ to give effective electrode activity. The density of projections or voids means the number of projected particles per $cm^2$ or the number of voids per $cm^2$. The thickness of the rough surface layer means the thickness of the layer formed with the particles or a thickness of the layer of the electrode substrate having voids.

The cathode of the present invention is obtained by discontinuously, uniformly distributing the fine electrically non-conductive material on the rough surface layer formed on the liquid non-permeable substrate of the gas evolution cathode. The fine, uniform and discontinuous distribution means that the uniformly adhered electrically non-conductive material is distributed in the form of separated spots, or strips connecting several to several tens of the spots on the surface of the electrode. It is usually considered that the aformentioned iron compound deposited during the electrolysis is relatively deposited on the projected parts of the rough surface layer and accordingly the electrically non-conductive material is preferably adhered in the form of spots or strips so as to cover the projected parts of the surface of the electrode.

In the present invention, it is important to use an electrically non-conductive material as the material for adhering on the rough surface layer of the electrode. When an electrically conductive material is deposited, the electrically conductive material is active as the electrode whereby the prevention of deposition of the impurities such as the iron compound is not attained.

The electrically non-conductive material can be various electrically insulating or ionic non-conductive inorganic or organic materials such as glass, porcelain enamel, ceramics and polymers. To secure a durability, it is preferable to be a water insoluble solid under the operation of the electrode. In view of strong adhesive force on the rough surface of the electrode and easy control of the adhered rate, the organic polymer is preferably employed.

Suitable organic polymers which are effectively employed can be various synthetic or natural resins or elastomers and particularly include synthetic polymers such as homopolymers and copolymers of a fluorinated olefin such as tetrafluoroethylene, chlorotrifluoroethylene, vinylidene fluoride, vinyl fluoride and hexafluoropropylene; a chlorinated olefin such as vinyl chloride and vinylidene chloride; an olefin such as ethylene, propylene, butene-1, or isobutyrene; aromatic unsaturated compound such as styrene; a diene such as butadiene, chloroprene or isoprene; a nitrile or nitrile derivative such as acrylonitrile, methacrylonitrile, methyl acrylate and methyl methacrylate; polycondensates or polyaddition polymer such as polyurethane, polyurethane urea, polyurea, polyamideimide, polyamide, polyimide, polysiloxane, polyketal and polyallylene ether; and the polymers having ionic conductivity which have an ion exchange group such as —COOH, —COONa, $—SO_3H$, $—SO_3Na$, $—CH_2N(CH_3)_3Cl$, $—CH_2N(CH_3)_3OH$, $—CH_2N(CH_3)_3(C_2H_4OH)Cl$, $—CH_2N(CH_3)_2(C_2H_4OH)OH$, $—CH_2N(CH_3)_2$ and $—CH_2NH(CH_2)—$; and natural macromolecular materials such as natural rubber, cellulose and polypeptide.

In the selection of the electrically non-conductive materials used in the present invention, it is preferable to consider the condition of use of the cathode such as an atmosphere, an electrolyte, a kind of evolved gas, a temperature and a rate of the evoluted gas to set a desired chemical resistance, heat resistance and mechanical strength; and moreover, it is preferable to consider an adhesive force on the surface layer of the electrode; and processibility in the adhering operation.

When the cathode is used as the cathode in an alkali metal salt type electrolytic cell, it is preferable to select a homopolymer or copolymer of a fluorinated olefin having excellent alkali resistance and heat-resistance such as perfluoro polymer such as polytetrafluoroethylene, tetrafluoroethylene-hexafluoropropylene copolymer, and tetrafluoroethyleneperfluoro-5-oxa-6-peptenic acid ester. When the cathode is used as a cathode in a cell for electrodialysis under relatively mild condition, the range of the suitable compounds can be broad.

The process for adhering the electrically non-conductive material on the cathode is not critical and can be any of various processes. For good control of an adhered amount, the dipping process, the spraying process or the electrophoretic process by using a solution or dispersion of the material can be employed as a preferable process. In accordance with said processes, the electrically non-conductive material can be finely, uniformly, discontinuously adhered on the surface of the cathode. The electrode holding the electrically non-conductive material with a solvent or a dispersion medium on the rough layer is dried or baked after drying to firmly adhere the non-conductive material on the surface of the cathode. In the case of the dipping process, the electrophoretic process, or the spraying process, the solution or the dispersion is preferably maintained in a uniform concentration by thoroughly stirring whereas the electrically non-conductive material is not uniformly adhered on the surface of the cathode.

The content of the electrically non-conductive material is preferably in a range of 0.3–10 $cc/m^2$ especially 0.5–9 $cc/m^2$ based on the apparent surface area of the electrode. The content is given by dividing adhered weight (g) of the electrically non-conductive material per $m^2$ of the apparent surface area of the electrode by the density of the material. The reason of the limitation of the content is as follows:

When the content is less than 0.3 $cc/m^2$, the deposition of the metal or the insoluble salt from the electrolyte on the surface of the electrode can not be effectively prevented whereas when it is more than 10 $cc/m^2$, the effective surface area of the electrode is reduced too small.

In order to control the electrically non-conductive material in said range, the concentration or viscosity of the solution or the dispersion is controlled in a suitable range to control the pick-up amount or the dipping times are controlled in the dipping process; and the sprayed amount and spray times are controlled in the spraying process and the current density or the time for current feeding is controlled to control quantity of electricity in the electrophoretic process. According to various studies, it is preferable to give a concentration of the solution or the dispersion in a range of 0.1–5 wt.% especially 0.5–5 wt.% in the dipping process. It is preferable to give particle diameters of the electrically non-conductive material in a range of 0.05–2$\mu$ especially 0.1–1$\mu$ depending upon the rough condition (distribution of projections, height or depth and width of projections or voids) on the surface.

The cathode of the present invention can be effectively used as the cathode for electrolysis of an alkali metal halide as will be further illustrated.

The cathode obtained by the codeposition of Raney nickel as disclosed in Japanese Unexamined Patent Publication No. 112785/1979 is preferably used. That is, the cathode substrate is immersed in a plating bath dispersing Raney nickel particles and particles are codeposited on the substrate by the electric plating process to obtain the cathode.

The cathode is dipped in a dispersion of the electron non-conductive material such as PTFE particles to hold the dispersion on the cathode and it is dried and baked to adhere PTFE particles as the electron non-conductive material on the cathode.

In this case, the electrochemically active particles can be made of the alloy of the first metal and the second metal or a leached alloy obtained by removing at least part of the second metal component from said alloy. The latter is preferably used because of the following reason.

In the former process, the particles are codeposited in the form of alloy and the electrically non-conductive material is adhered on the particles and then at least part of the second metal is removed. The reason for resulting the preferable result is not clear. But, it is believed that a part of the electrically non-conductive material adhered is removed together with the second metal in the leaching of the second metal whereby the electron non-conductive material adhered on the deep parts of voids of the rough surface layer of the cathode may be removed.

The resulting cathode of the present invention can be used as the gas evolution cathode in various fields especially as the cathode for electrolysis of an aqueous solution of an alkali metal halide, sea water (brine), water or hydrochloric acid or other halogen acids.

The electrolysis of an aqueous solution of an alkali metal halide especially sodium chloride by the use of the cathode of the present invention will be illustrated in detail. The use of the cathode of the present invention is not limited to the electrolysis of an aqueous solution of sodium chloride.

As an electrolysis of an aqueous solution of sodium chloride, the process of the use of a diaphragm such as asbestos and the process of the use of a cation exchange membrane have been industrially employed. The cathode of the present invention can be used in both processes of the electrolysis.

When the cathode of the present invention is used as the cathode in the electrolysis, the cathode obtained by adhering the electrically non-conductive material such as PTFE by said process on the cathode obtained by the codeposition of Raney nickel particles; or obtained by plasma coating; or obtained by sand-blasting stainless steel or iron, can be used. The resulting cathode is combined with the conventional anode and a diaphragm made of asbestos etc. or a cation exchange membrane of a fluorinated polymer having carboxylic acid groups or sulfonic acid groups as the ion exchange groups. Said diaphragm or membrane is placed between the anode and the cathode to form an anode compartment and a cathode compartment. Into the anode compartment, an aqueous solution of sodium chloride is fed to perform the electrolysis.

In accordance with the electrolysis, sodium hydroxide is produced in the cathode compartment. Depending upon the concentration of the aqueous solution of sodium hydroxide, iron component is dissolved from the material of the cathode compartment. Even though it is small the iron component is easily deposited on the cathode during a long time.

In the case of the cathode of the present invention, the electrically non-conductive material is adhered on the surface of the cathode especially projected parts of the surface layer on which the iron compound would be easily deposited, whereby the adhesion of the iron compound on such parts is avoidable.

The present invention will be further illustrated by certain examples and references which are provided for purposes of illustration only and are not intended to be limiting the present invention.

EXAMPLE 1

Powdery unleached Raney nickel (Ni: 50%; Al: 50%; 200 mesh pass) (Kawaken Fine Chemical Co., Ltd.) was dispersed at a ratio of 10 g./liter into a nickel chloride bath ($NiCl_2.6H_2O$: 300 g./liter; $H_3BO_3$: 38 g./liter). The mixture was thoroughly mixed and a composite coating was carried out in a dispersion on an expanded type iron substrate (5 cm×5 cm) having an undercoated nickel layer having a thickness of 20μ, under a condition of a current density of 3 A/dm$^2$; pH of 2.0 at 40° C. for 1 hour by using a pure nickel as an anode. The electrodeposited composite coating had a thickness of 200μ and contained. Ni-Al alloy particles at a content of about 38% in the layer.

The rough surface had projections of Raney nickel alloy particles at a rate of $2.5\times10^5$/cm$^2$ and the thickness of the composite coating was about 200μ.

The product was washed with pure water and dried and dipped for about 5 min. into a dispersion obtained by diluting an aqueous dispersion of PTFE (Teflon 30J: Mitsui Fluorochemical Co.: solid concentration of 60 wt.%; average diameter of 0.3μ) by 30 times with pure water, taking up water drops remained at the lower edge of the product was removed with a filter paper and the product was dried in a drier and then, heat-treated at 350° C. in nitrogen gas atmosphere for about 1 hour. After cooling the product, aluminum component was leached by treating the product in 20% NaOH aqueous solution at 80° C. for 2 hours. A content of the PTFE particles was 1.7 cc/m$^2$.

A hydrogen overvoltage of the resulting electrode was measured in 35% NaOH aqueous solution at 90° C. at a current density of 20 A/dm$^2$. It was 80 mV.

The resulting leached Raney nickel co-deposited electrode was used as a cathode and a titanium substrate coated by ruthenium oxide was used as an anode, and a perfluorocarboxylic acid type cation exchange membrane ("Flemion" membrane; Asahi Glass Co.) was placed for partitioning in an electrolytic cell and an electrolysis of an aqueous solution of sodium chloride was carried out under controlling a concentration of NaOH in the catholyte to be 35% and maintaining Fe ions at about 100 ppm as Fe at 90° C. and 20 A/dm$^2$. After the electrolysis, for about 20 days, the hydrogen overvoltage of the cathode was about 80 mV which did not change from the initiation of the electrolysis.

EXAMPLE 2

In accordance with the process of Example 1, the leached Raney nickel cathode treated with the PTFE dispersion was prepared. An asbestos diaphragm was closely brought into contact with the cathode. An electrolysis of an aqueous solution of sodium chloride was carried out by using an aqueous solution of sodium chloride as an anolyte under a condition of a concentration of NaOH in a catholyte of 10% and a concentration of NaCl of 16% and maintaining Fe ions at about 30 ppm as Fe at 90° C. and 20 A/dm$^2$ for about 20 days. After the electrolysis, the hydrogen overvoltage was about 80 mV which did not change from the initiation of the electrolysis.

EXAMPLE 3

In accordance with the process of Example 1, a non-leached Raney nickel electrode having a content of Ni-Al alloy powder of about 38% was prepared and was leached in 20% NaOH aqueous solution at 80° C. for 2 hours and the electrode was treated with the PTFE dispersion. A content of the PTFE particles was 1.9 cc/m$^2$.

In accordance with the process of Example 1, an electrolysis was carried out in the presence of Fe ions. The hydrogen overvoltage was 80 mV at the initiation of the electrolysis and about 90 mV after the electrolysis for 20 days.

EXAMPLE 4

In accordance with the process of Example 1, a leached Raney nickel electrode treated with a polystyrene dispersion was prepared. As the polystyrene dispersion, polystyrene uniform latex (solid concentration of 10%; average diameter of 0.11μ) (Dow Chemical Co.) diluted by 5 times with water was used. The electrode was prepared by drying at 90° C. without heating at higher temperature. A content of polystyrene was 2 cc/m$^2$.

In accordance with the process of Example 1, an electrolysis of an aqueous solution of sodium chloride was carried out by using the resulting electrode at 70° C. After about 20 days the hydrogen overvoltage was about 100 mV which did not change from the initiation of the electrolysis.

EXAMPLE 5

In accordance with the process of Example 1, the Ni-Al alloy powder deposited electrode was prepared and was dipped in a 2% solution of tetrafluoroethylene-propyleneglycidyl ether copolymer ("Aflas" for coating: molecular weight of about $2.5\times10^4$) (Asahi Glass Co.) in butyl acetate and the electrode taken-up was heat-treated at 150° C. for 1 hour without using any curing agent. Then, aluminum component was leached by the process set forth in Example 1. A content of the copolymer was 1.2 cc/m$^2$.

In accordance with the process of Example 1, the cathode was used for the measurement of the hydrogen overvoltage and the electrolysis test. After about 20 days, the hydrogen overvoltage was 100 mV which did not change from the initiation of the electrolysis.

EXAMPLE 6

An expanded metal made of SUS-316L (5 cm×5 cm) was treated by an alkali etching treatment, in 65% NaOH at 165° C. for 50 hours. The product was dipped in the PTFE dispersion of Example 1 diluted by 15 times with water and the product taken-up was dried at 100° C. and baked in nitrogen gas atmosphere at 350° C. for 1 hour and then, was again treated by an alkali etching treatment in 65% NaOH at 165° C. for 20 hours. A content of the PTFE was 0.9 cc/m$^2$. A hydrogen overvoltage of the product as the cathode in 35% NaOH aqueous solution at 90° C. was 100 mV. In accordance with the process of Example 1, the electrolysis was carried out. After about 20 days, the hydrogen overvoltage was 100 mV which did not change from the initiation.

EXAMPLE 7

In accordance with the process of Example 1, the Raney nickel alloy particle co-deposited electrode was prepared and was washed with water and dipped in an aqueous dispersion of tetrafluoroethylene-hexafluoropropylene copolymer (FEP) (Teflon 120: Mitsui Fluorochemical Co.; solid concentration of 56 wt.%) diluted by 30 times with water for 10 min. and taken-up and the water drops remained at the lower edge was removed with a filter paper and the product was dried and baked in argon atmosphere at 300° C. for 1 hour and aluminum component was leached. A content of the FEP was 1.9 cc/m$^2$.

In accordance with the process of Example 1, the cathode was used for the measurement of the hydrogen overvoltage and the electrolysis test. After about 20 days, the hydrogen overvoltage was 80 mV which did not change from the initiation of the electrolysis.

REFERENCE 1

In accordance with the process of Example 1, Ni-Al alloy particle co-deposited electrode was prepared and aluminum component was leached in 20% NaOH aqueous solution at 80° C. to activate it. A hydrogen overvoltage in 35% NaOH aqueous solution at 90° C. was about 100 mV. In accordance with the process of Example 1, the electrolysis test was carried out in the presence of Fe ions. After about 20 days, the hydrogen overvoltage increased to 200 mV.

REFERENCE 2

In accordance with the process of Example 6, the alkali-etched SUS-316L electrode was prepared by etching it for 70 hours. In accordance with the process of Example 1, the resulting electrode was used for the measurement of the hydrogen overvoltage and the electrolysis test. The hydrogen overvoltage increased from 100 mV as the initial value to 200 mV after about 20 days.

EXAMPLE 8

An expanded type iron substrate (5 cm×5 cm) having a undercoat nickel layer having a thickness of about 20μ was electrically plated in a plating bath ($NiCl_2.6H_2O$: 238 g./liter; $ZnCl_2$: 136 g./liter; $H_3BO_3$: 30 g./liter) at pH of 4.0 and a current density of 1 A/dm$^2$ and a temperature of 40° C. for about 120 min. The resulting cathode was leached in 10% NaOH aqueous solution at room temperature for about 15 min. The rough surface of the electrode was formed by the etching. A density of projections was $3\times10^6$/cm$^2$ and a thickness of the rough surface was about 50μ. A content of PTFE was 0.6 cc/m$^2$ which was given by washing and drying followed by the dipping, the drying and the baking treatment with the diluted PTFE dispersion of Example 1. The product was leached in 20% NaOH aqueous solution at 80° C. for 1 hour. In accordance with the process of Example 1, the resulting electrode was used for electrolysis test. After about 20 days, the hydrogen overvoltage was about 90 mV which did not substantially change from the initiation of the electrolysis.

REFERENCE 3

In accordance with the process of Example 8, the Ni-Zn plated electrode was prepared and leached in 20% NaOH aqueous solution at 80° C. for 70 min.

In accordance with the process of Reference 1, the electrolysis test was carried out. The hydrogen overvoltage increased from 100 mV at the initiation to 220 mV after 20 days.

EXAMPLE 9

Powdery unleached Raney nickel (Ni: 50%; Al: 50%; 200 mesh pass) (Kawaken Fine Chemical Co., Ltd.) was dispersed at a ratio of 10 g./liter into a nickel chloride bath ($NiCl.6H_2O$:300 g./liter; $H_3BO_3$:38 g./liter). The mixture was thoroughly mixed and a composite coating was carried out in a dispersion on an expanded type iron substrate (5 cm×5 cm) having an undercoated nickel layer having a thickness of 20μ under a condition of a current density of 3 A/dm$^2$; pH of 2.0 at 40° C. for 1 hour, by using a pure nickel as an anode. The composite coating had a thickness of 200μ and contained Ni-Al alloy particles at a content of about 38% in the layer.

The rough surface had projections of Raney nickel alloy particles at a rate of $2.5\times10^5$/cm$^2$ and the thickness of the composite coating was about 200μ.

The product was washed with pure water and dried and dipped for about 5 min. into an aqueous dispersion of a copolymer of tetrafluoroethylene (83 mol.%) and methylperfluoro-5-oxa-6-heptenoate ($CF_2=CFO(CF_2)_3COOCH_3$)(17 mol%) (average diameter of 0.2μ; solid concentration of 10 wt.%). After taking up, water drops remained at the lower edge of the product was removed with a filter paper and the product was dried in a drier and then, heat-treated at 200° C. in nitrogen gas atmosphere for about 1 hour. After cooling the product aluminum component was leached by treating the product in 20% NaOH aqueous solution at 80° C. for 2 hours. In the treatment about 100% of —$COOCH_3$ groups were hydrolyzed into —$COONa^+$ groups. A content of the copolymer was 8.5 cc/$m^2$.

A hydrogen overvoltage of the resulting electrode was measured in 35% NaOH aqueous solution at 90° C. at a current density of 20 A/$dm^2$. It was 80 mV.

The resulting leached Raney nickel co-deposited electrode was used as a cathode and a titanium substrate coated by ruthenium oxide was used as an anode and a perfluorocarboxylic acid type cation exchange membrane ("Flemion" membrane: Asahi Glass Co.) was placed for partitioning the electrodes in an electrolytic cell and an electrolysis of an aqueous solution of sodium chloride was carried out under controlling a concentration of NaOH in the catholyte to be 35% and maintaining Fe ions at about 100 ppm as Fe. After the electrolysis for about 20 days, the hydrogen overvoltage was about 80 mV which did not change from the initiation of the electrolysis.

In the examples, the variation of hydrogen overvoltage was tested by the electrolysis for an acceleration test.

Each surface of the gas evolution cathode obtained in Examples 1 to 9 was observed by Scanning Electron Microscope (SEM) (S-450 manufactured by Hitachi Seisaku Sho).

The results of the observation are stated in Table 1. The electron nonconductive material was adhered on projections or voids of the cathode in a form of spots (10–300μ).

TABLE 1

| Example | Size (cc/$m^2$) | SEM observation of surface |
|---|---|---|
| 1 | 20–100μ (1.7) (PTFE) | Adhered selectively on projections in a form of spots |
| 2 | 20–100μ (1.7) (PTFE) | Adhered selectively on projections in a form of spots |
| 3 | 10–150μ (1.9) (PTFE) | Adhered mainly on projections in a form of spots |
| 4 | 50–150μ (2) (polystyrene) | Adhered mainly on projections in a form of spots |

TABLE 1-continued

| Example | Size (cc/$m^2$) | SEM observation of surface |
|---|---|---|
| 5 | 50–150μ (1.2) (Aflas) | Adhered mainly on projections in a form of spots |
| 6 | 20–50μ (0.9) (PTFE: 316 LT) | Adhered selectively on projections in a form of spots |
| 7 | 50–100μ (1.9) (Teflon) | Adhered selectively on projections in a form of spots |
| 8 | 10–50μ (0.6) (PTFE) | Adhered selectively on projections in a form of spots |
| 9 | 100–300μ (8.5) (CMX) | Deposited in voids in a form of spots |

We claim:

1. A method of electrolyzing an aqueous solution of an alkali metal halide, sea see water, water or a hydrogen halide, which comprises:

conducting said electrolysis an an electrolysis device, the cathode of which is a gas evolution cathode constructed of a liquid non-permeable substrate having a rough surface layer which is formed by the deposition of electrochemically active particles on said liquid non-permeable substrate, said rough surface layer having a fine electron non-conductive material discontinuously, but uniformly dispersed thereon.

2. The method according to claim 1, wherein said electron non-conductive material is distributed in an amount of 0.3–10 cc per $m^2$ of the apparent surface area of said rough surface layer.

3. The method according to claim 1, wherein said electron non-conductive material is an organic polymer.

4. The method according to claim 1, wherein said rough surface layer has a thickness of 1–1000μ and the density of projections or voids of said porous surface layer ranges from $10^4$–$10^{12}$ per $cm^2$.

5. The method according to claim 1, wherein said electrochemically active particles are made of an alloy of a first metal selected from the group consisting of Ni, Co, Ag, Pt, Pd, Fe and Cu and a second metal selected from the group consisting of Al, Zn, Mg, Sn, Si and Sb or a leached alloy obtained by leaching at least a part of said second metal component from said alloy.

6. The method according to claim 2, wherein said electron non-conductive material is an organic polymer.

* * * * *